US005557868A

United States Patent [19]

Tabary et al.

[11] Patent Number: 5,557,868

[45] Date of Patent: Sep. 24, 1996

[54] MODULES FOR DISPLAYING ADVERTISING IMAGES, AND A DISPLAY ASSEMBLY

[75] Inventors: Guy A. Tabary, Luynes; Alain A. R. Tabary, Louans, both of France

[73] Assignee: Societe Civile D'Innovation, Luynes, France

[21] Appl. No.: 271,156

[22] Filed: Jul. 6, 1994

[51] Int. Cl.[6] ..... G09F 11/18

[52] U.S. Cl. ..... 40/471; 40/466

[58] Field of Search ..... 40/471, 518, 466, 40/611, 610; 248/188.5

[56] References Cited

U.S. PATENT DOCUMENTS

| | | | |
|---|---|---|---|
| 1,120,982 | 12/1914 | Schroeder | 40/466 |
| 1,714,650 | 5/1929 | Webb | 40/518 |
| 1,813,062 | 7/1931 | Liss | 40/466 |
| 2,419,802 | 4/1947 | Van Horne | 40/471 |
| 3,426,461 | 2/1969 | Miller | 40/471 |
| 3,616,554 | 11/1971 | Singer et al. | 40/471 |
| 3,780,458 | 12/1973 | Jacoby et al. | 40/471 |
| 4,043,277 | 8/1977 | Wallace | 248/188.5 X |
| 4,322,905 | 4/1982 | Kruse | 40/611 X |

FOREIGN PATENT DOCUMENTS

| | | |
|---|---|---|
| 0402494 | 12/1990 | European Pat. Off. . |
| 054173 | 5/1993 | European Pat. Off. . |
| 2659161 | 9/1991 | France . |
| 3625969 | 12/1988 | Germany . |

*Primary Examiner*—Joanne Silbermann
*Attorney, Agent, or Firm*—Burgess, Ryan and Wayne

[57] ABSTRACT

A display module for displaying advertising images, is provided. The module may be independent or may constitute one of the elements in a display assembly. The module has a housing having an opening in its front face and a movable strip of images behind the opening in the front face. The strip is moved by two horizontal cylinders which are individually driven by two drive motors arranged between the cylinders and controlled by a control unit. The housing includes framework located close to its back face. The module is compact and light in weight for a large area of window. A removable stretcher is inside the module and is accessible through the opening because the strip is made up of a plurality of elements interconnected by slider fastening means. The display module has supports and handles so that it can stand alone and can be easily carried.

10 Claims, 4 Drawing Sheets

FIG_3
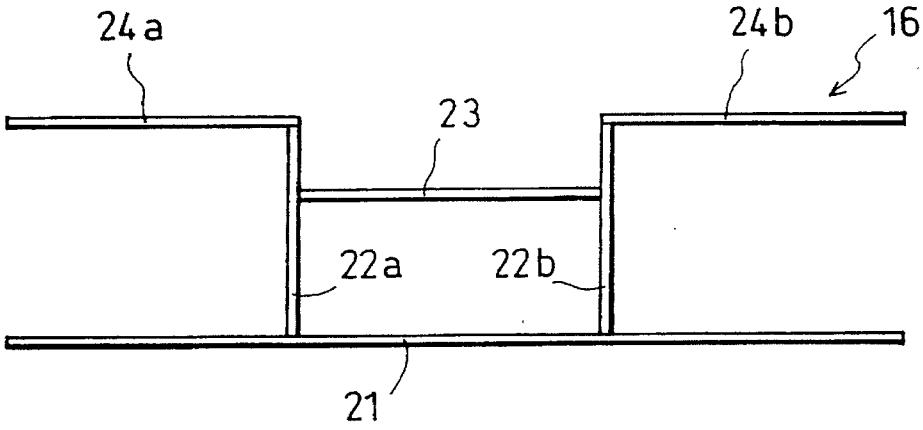
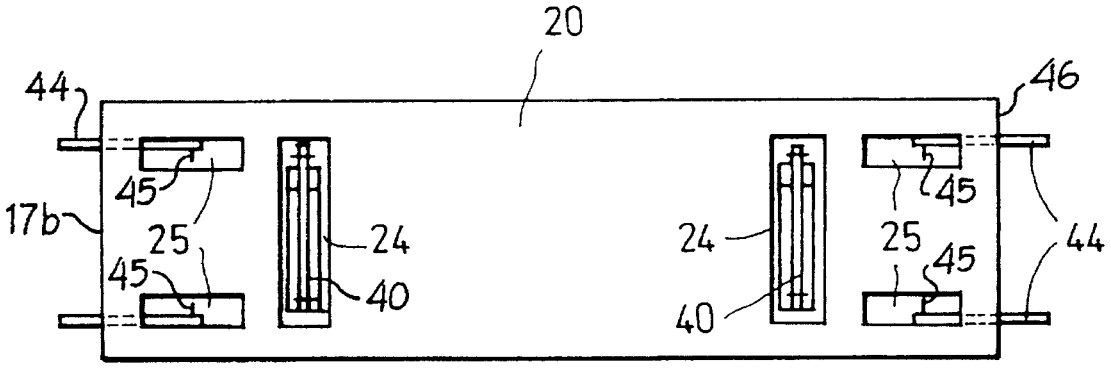
FIG_4

MODULES FOR DISPLAYING ADVERTISING IMAGES, AND A DISPLAY ASSEMBLY

FIELD OF THE INVENTION

The present invention relates to a module for displaying advertising images, the module being of the type comprising a housing having a display opening in its front face, a device for causing an image-support strip to move past said opening, drive means for driving said device for moving the strip, detectors for detecting the position of the strip, an electronic control unit connected to the drive means and to said detectors and designed to control the rate at which images are displayed, and a power supply.

BACKGROUND OF THE INVENTION

Such modules are used in particular to show advertising images at the locations of sports events that are going to be televised, e.g. at football grounds. They are then placed side by side to form a display assembly constituted by a plurality of modules capable of operating in unison when the modules are connected to an electronic control center. If the control center is programmable, then the rate at which the various images are displayed may vary in duration. However, each module may operate independently, in which case it is controlled by its own electronic control unit.

Such assemblies are described, in particular in FR-A-2 589 272, EP-A-0 402 494, FR-A-2 659161, EP-A-0 541 730, and DE-A-3 625 969.

Such display assemblies which may extend over a length of as much as 210 meters are expensive, and for reasons of economy, they are also dismountable for being transported from one ground to another as a function of which matches are going to be televised.

The modules presently in use are bulky and heavy. They are about 1 meter high, 45 cm deep, about 180 cm long, and they have a unit weight of about 190 kg. A display assembly comprises 116 modules giving a total weight of 22 metric tons and a volume of 93 cubic meters. Such an assembly therefore requires two semi-trailers to move it.

OBJECT AND SUMMARY OF THE INVENTION

The object of the present invention is to provide a novel module which, for equivalent image area, is less voluminous and lighter in weight, so that only one trailer is required for moving an entire assembly, and so that the time required for putting up or taking down a display assembly is considerably reduced.

The invention achieves its object by the following dispositions:

- in the vicinity of its back face, the housing includes a rigid framework made up of an assembly of section bars, sideplates fixed to said framework and extending towards the opening, a bottom cap, and a top cap;
- the device for moving the strip comprises two horizontal cylinders carried by said sideplates and on which the strip is wound, said cylinders being disposed in the immediate vicinity of respective ones of the top and bottom caps, between the opening and the framework;
- the drive means include two electric motors carried by one of said sideplates, and disposed substantially between said cylinders; and
- handles are also provided that are retractable and suitable for projecting from the side plates.

Because of the way the motors and the cylinders are disposed, and because of the absence of any deflection rollers, the depth of a module is limited to about 17 cm, thereby making it possible to reduce the volume of the display assembly very considerably.

The horizontal disposition of the cylinders makes it possible to use an image-supporting strip that is very wide without requiring a strip-tensioner device or a longitudinal strip guide device as are essential when the strip moves horizontally. The stiffness of the housing is provided solely by the framework and the sideplates together with the disposition of the cylinders. The module proposed by the invention weighs less than 100 kg for a length of about 3 meters. The total weight of a 210 meter long assembly is about 7 metric tons for a volume of 35 cubic meters.

The following advantageous dispositions are preferably adopted:

- each module further includes a removable stretcher disposed vertically between said cylinders; the retractable handles can serve to hold together two adjacent modules in a display assembly;
- the strip includes a plurality of elements interconnected by slider fastening means so as to permit rapid access to the stretcher and to the motors;
- each module is fitted with retractable support means comprising at least one telescopic tube hinged at one end to the rear face of the housing and at the opposite end to a housing support plate; and
- at its side opposite to its hinge axis, the bottom cap has a cylindrical portion that partially covers the adjacent cylinder, and the support plate includes a cradle suitable for rotatably receiving said cylindrical portion.

BRIEF DESCRIPTION OF THE DRAWINGS

Other advantages and characteristics of the invention appear on reading the following description given by way of non-limiting example and made with reference to the accompanying drawings, in which:

FIG. 3 shows the framework of the housing;

FIG. 4 is a rear view of a module;

MORE DETAILED DESCRIPTION

Figure 1:
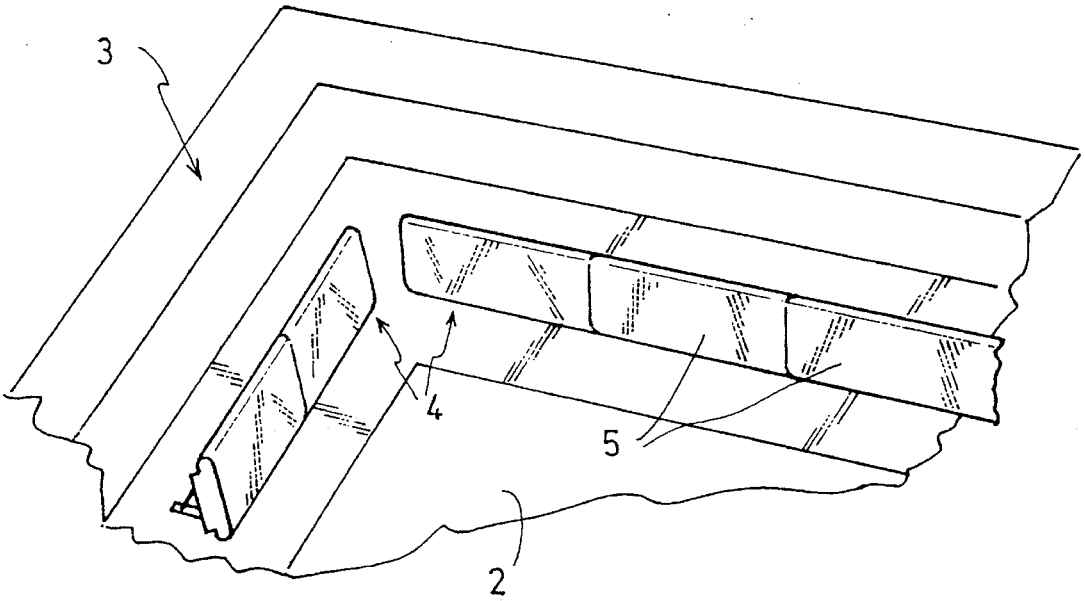
FIG. 1 is a perspective view showing how a display assembly of the invention is disposed around the location of a sporting event.
Figure 2:
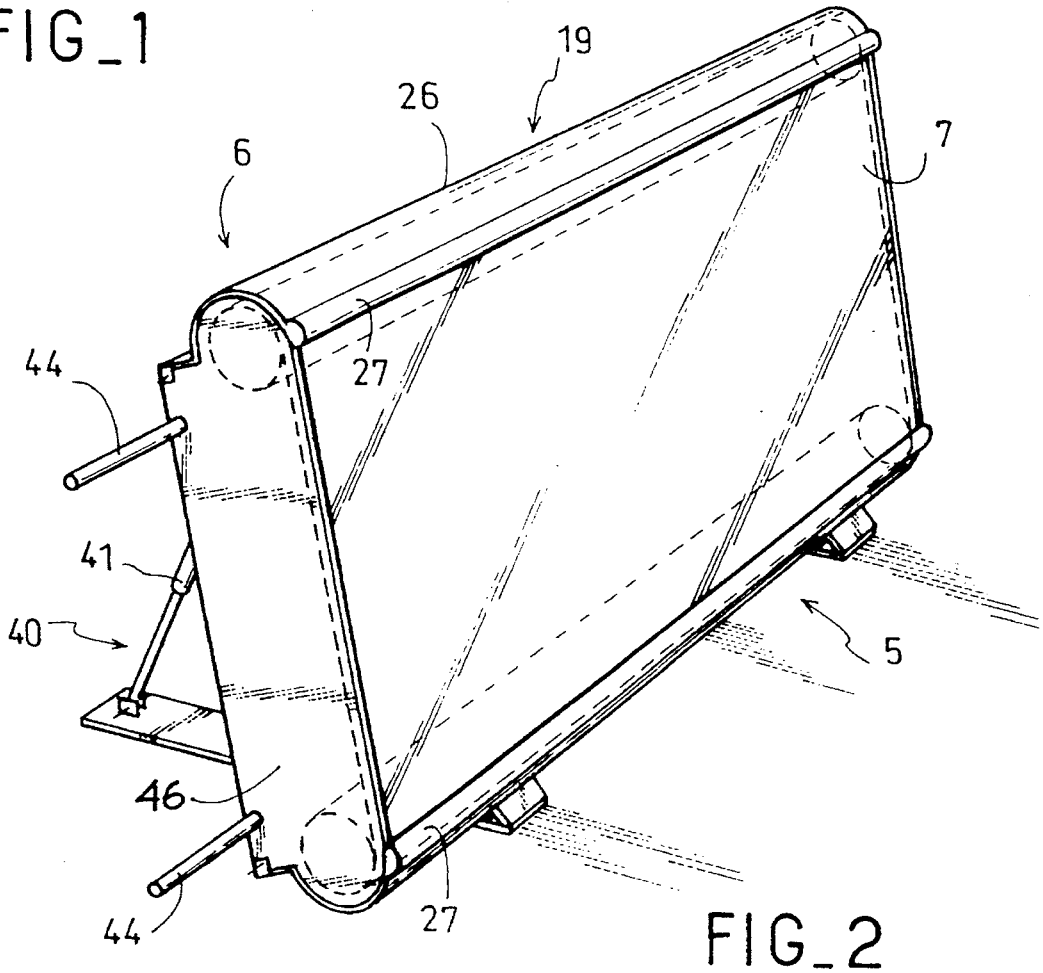
FIG. 2 is a perspective view on a larger scale showing the disposition of a module standing on the ground.
Figure 5:
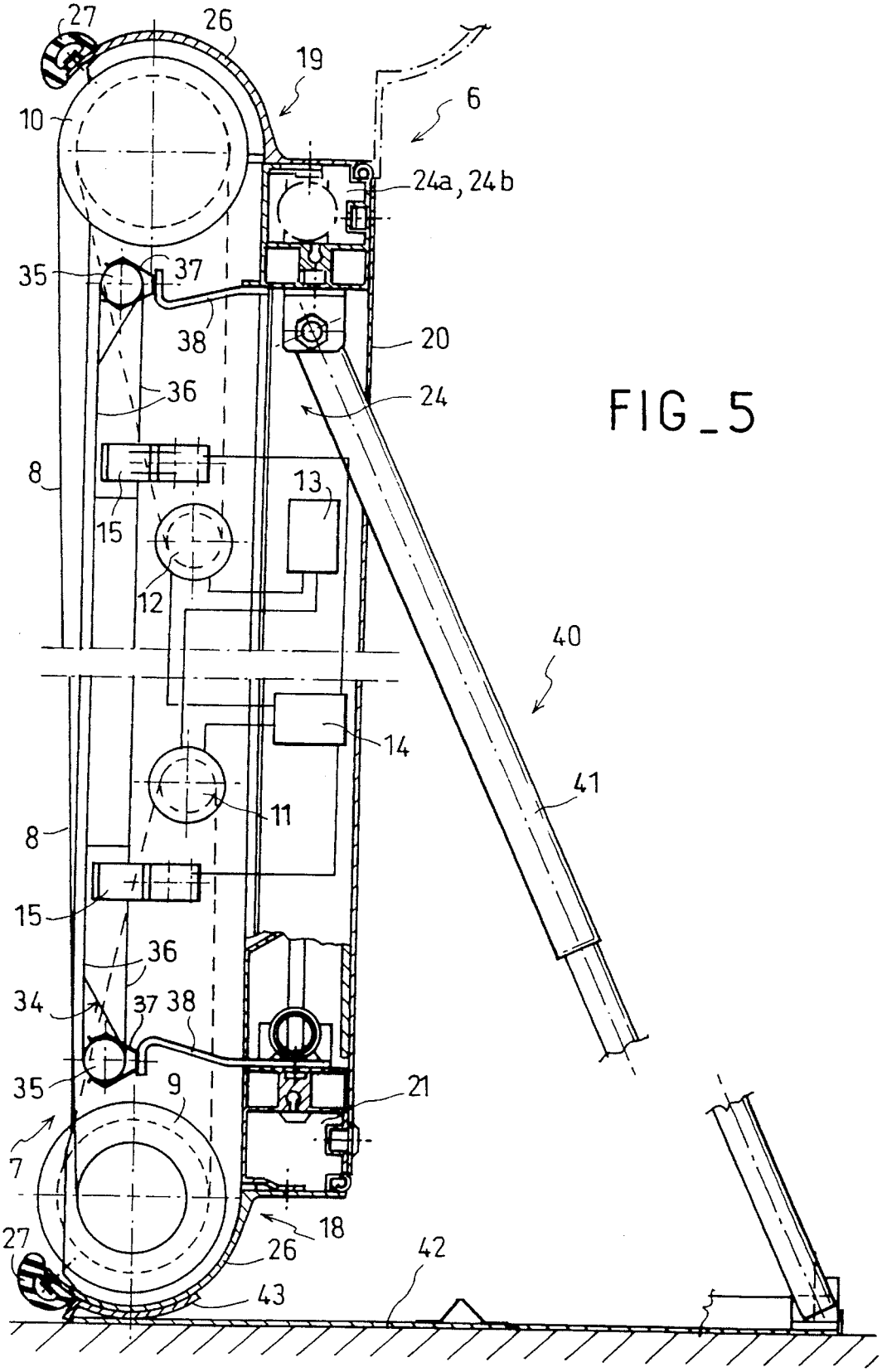
FIG. 5 is a cross-section through a module.
Figure 6:
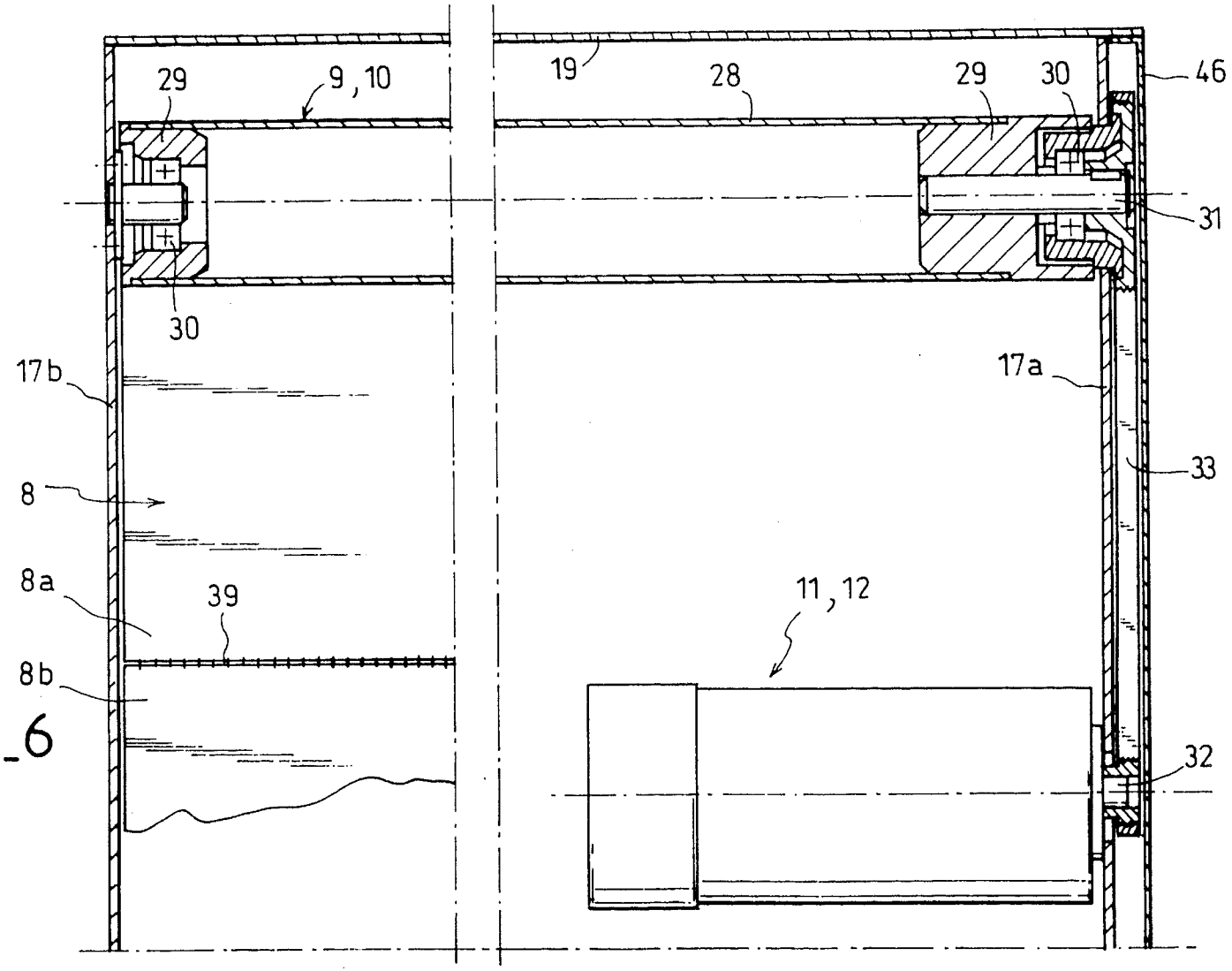
FIG. 6 is a section through the module on a plane that includes the axis of a cylinder and the axis of a motor.

FIG. 1 shows a football stadium having an assembly 4 for displaying advertising images disposed around the playing field 2 just in front of the stands 3. The assembly 4 is made up of a plurality of identical display modules 5 juxtaposed side by side.

Each module 5 comprises a housing 6 having a rectangular opening 7 in its front face with an image-supporting strip 8 running behind said opening. The strip 8 is wound on two horizontal cylinders: a bottom cylinder 9, and a top cylinder 10. The cylinders are driven by electric motors 11 and 12 powered by batteries 13 and controlled by an electronic control unit 14. Image position sensors 15 are connected to the electronic control unit and are disposed behind the strip 8. The module 5 can operate independently. It can also be remotely controlled, either from the electronic control unit of another module, or else from an electronic control center, e.g. a computer. Under such circumstances, the modules 5 of a display assembly 4 are connected in series.

The housing 6 includes a rigid framework 16 which is disposed in the vicinity of the rear face of the module and on which there are mounted: sideplates 17*a* and 17*b* which extend towards the opening 7; a bottom cap 18; a top cap 19; and a protective backplate 20.

The framework 16 is made by assembling together elements taken from a single bar of lightweight material, and preferably from an aluminum extrusion. It comprises a bottom length member 21 which extends along the entire length of the module 5, two intermediate uprights 22*a* and 22*b* fixed perpendicularly to the bottom length member 21, a cross-bar 23 interconnecting the uprights 22*a* and 22*b*, and two length member top portions 24*a* and 24*b* extending away from each other from respective top ends of the uprights 22*a* and 22*b*.

The protective backplate 20 includes cavities 24 and 25 that open out to the back and that extend between the bottom length member 21 and the top length member portions 24*a* and 24*b*.

The cylinders 9 and 10 are disposed between respective length members 21 and 24*a* & 24*b* and the opening 7 in the immediate vicinity of the top and bottom caps 19 and 18. Each of the caps 18 and 19 has a cylindrical portion 26 that covers part of the adjacent cylinder 9, 10 and that is fitted on its front edge with flexible protective beading 27. The cylinders 9 and 10 each comprise an aluminum tube 28 fitted at each end with a hub 29 that is mounted to one of the sideplates 17*a* and 17*b* by means of a rotary bearing 30. One of said hubs includes a drive shaft 31. The drive motors 11 and 12 for the cylinders 9 and 10 are mounted on one of the sideplates 17*a* and they are disposed substantially between the two cylinders 9 and 10. Each of them includes a drive shaft 32 that projects from the outside face of the sideplate and that is connected to the drive shaft 31 of the corresponding cylinder by means of a drive belt 33 mounted on pulleys.

A removable stretcher 34 including a metal frame 35 and a sheet 36 is disposed vertically inside the housing 6 behind the strip 8. It is held in place by means of quick fastenings 37 mounted on tabs 38 fixed to the length members 21, 24*a*, and 24*b*.

To provide access to the stretcher via the opening 7, the strip is made up of a plurality of elements 8*a*, 8*b* that are connected together by slider fixing means 39, each element including one advertising image.

The cavities 24 provided in the protective backplate 20 are designed to receive retractable support means 40. These support means 40 comprise a telescopic tube 41 hinged at its top end to the backplate and hinged at its bottom end to a support plate 42 designed to be placed on the ground and which includes a cradle 43 of cylindrical shape suitable for rotatably receiving the cylindrical portion 26 of the bottom cap 18.

Snap-fastening means are provided to hold the support means 40 in the folded state inside the cavity 24. In conventional manner, the telescopic tube 41 includes means for adjusting its length. The support means 40 enable the module 5 to be positioned at a desired slope.

Each module 5 also includes retractable handles 44 capable of emerging from the outside faces of the sideplates 17*a* and 17*b*. There are two such handles 44 per sideplate 17*a*, 17*b*, and they are slidably mounted in receptacles constituted by tubes fixed to the length members, with their inside ends being provided with respective indexing pegs 45 that are accessible via the cavities 25. When extended, the handles enable a module 5 to be carried by two men. In contrast, when retracted, it is possible for the handle 44 of an adjacent module to be inserted into the empty end of the receptacle containing the retracted handle, thereby holding two modules together.

The bottom and top caps 18 and 19 are hinged via their rear edges to the length members 21, 24*a*, and 24*b* so as to enable them to be opened outwards to give access to the cylinders 9 and 10.

To protect the belts 33, a protective side cover 46 is provided over the sideplate 17*a*.

The dimensions of the proposed module 5 are about 80 cm high, 17 cm thick, and 300 cm long. The weight of the module is less than 100 kg. The power of each motor is about 85 watts. The strip 8 may include about 25 images.

We claim:

1. A module for displaying advertising images, the module comprising a housing having a back face and a front face and a display opening in the front face, moving means for moving an image support strip past said display opening, drive means for driving the moving means detectors for detecting the position of the image-support strip, an electronic control unit connected to the drive means and to said detectors to control the rate at which images are displayed, and a power supply, wherein:

in the vicinity of the back face, the housing includes a rigid framework having sides, and rigid framework comprising an assembly of section bars, a sideplate fixed to each side of said framework and extending toward the display opening, a bottom cap, and a top cap;

the moving means for moving a strip comprising a first horizontal cylinder and a second horizontal cylinder on which the strip is wound, the cylinders comprising drive shafts, the cylinders being carried by said sideplates, the first cylinder being disposed and the second cylinder being disposed in the immediate vicinity of the bottom cap between the display opening and the framework, and wherein each of the top and bottom caps has a front portion that overlies a portion of the adjacent horizontal cylinder;

the drive means comprising a first electric motor and a second electric motor mounted on one of said sideplates, and disposed between said cylinders, the first motor being connected to the drive shaft of said first cylinder and the second motor being connected to the drive shaft of said second cylinder.

2. A module according to claim 1, further including a removable stretcher disposed vertically between said cylinders and behind the strip.

3. A module according to claim 1, wherein the strip includes a plurality of elements interconnected by slider fastening means.

4. A module according to claim 1, further including retractable support means received in a cavity formed in the back face.

5. A module according to claim 4, wherein the support means comprise at least one telescopic tube hinged at one end to the back face of the housing and at the other end to a support plate said.

6. A module according to claim 5, wherein the bottom cap has a cylindrical portion covering a portion of the adjacent cylinder and wherein the support plate for said housing includes a cradle suitable for rotatably receiving said cylindrical portion.

7. A display assembly for displaying advertising messages, comprising a plurality of modules according to claim 1 juxtaposed side by side, said modules operating independently or controlled together by the electronic control unit of one of said modules or by an electronic control center.

8. An assembly according to claim 7, wherein the modules further comprise retractable handles arranged to project from said slide plates and wherein the handle of one module can penetrate at least in part into a handle receptacle of an adjacent module in order to increase the rigidity of said assembly.

9. The module of claim 1 wherein said first motor is connected to a driveshaft of the first cylinder by means of a drive belt and said second motor is connected to a drive shaft of the second cylinder by means of a drive belt.

10. The module of claim 1 further comprising retractable handles arranged to project from said side plates.

* * * * *